US008371996B2

(12) United States Patent
McAtarian

(10) Patent No.: US 8,371,996 B2
(45) Date of Patent: Feb. 12, 2013

(54) SYSTEM FOR RAPID IDENTIFICATION AND USE OF PROPER SPILL REMEDIATION MATERIALS

(75) Inventor: Patrick F. McAtarian, St. Mary's, KS (US)

(73) Assignee: Andax Industries LLC, St. Mary's, KS (US)

( * ) Notice: Subject to any disclaimer, the term of this patent is extended or adjusted under 35 U.S.C. 154(b) by 724 days.

(21) Appl. No.: 12/491,645

(22) Filed: Jun. 25, 2009

(65) Prior Publication Data

US 2010/0326863 A1 Dec. 30, 2010

(51) Int. Cl.
*E02D 31/00* (2006.01)

(52) U.S. Cl. ..... 588/260; 588/900

(58) Field of Classification Search ..... 588/260, 588/300, 400, 261, 900
See application file for complete search history.

(56) References Cited

U.S. PATENT DOCUMENTS 6,640,825 B2 * 11/2003 McAtarian ..... 137/312

* cited by examiner

*Primary Examiner* — Edward Johnson
(74) *Attorney, Agent, or Firm* — Hovey Williams LLP

(57) ABSTRACT

Material spill remediation packages (16, 40) designed to counteract particular, different types of material releases or spills are provided having spill control assemblies (18, 41) within vacuumized casings (20) and including respective color-coordinated displays (22, 42) and detachable labels (26, 46) for particular spill or release materials. In use, possible locations of material spills are identified and the appropriate labels (26, 46) are applied at or near these locations, prior to the occurrence of any spill. In the event of a spill, the appropriate spill control assembly (18, 41) can be readily identified by matching the color of the label (26, 46) and the color-coded display (22, 42) associated with the appropriate package (16, 40). This allows rapid, error-free response to both hazardous and non-hazardous material releases or spills, even by relatively unskilled personnel.

11 Claims, 2 Drawing Sheets

SYSTEM FOR RAPID IDENTIFICATION AND USE OF PROPER SPILL REMEDIATION MATERIALS

BACKGROUND OF THE INVENTION

1. Field of the Invention

The present invention is broadly concerned with an improved material spill control systems allowing rapid and error-free use of appropriate spill remediation materials for particular types of spills. More particularly, the invention is concerned with such systems, methods of identifying, controlling and counteracting spills, and material spill products, wherein respective, specially designed spill control packages are provided with color-coordinated displays and detachable labels for particular, different types of hazardous and non-hazardous materials. The labels may be detached from the packages and placed at or near a location of likely spill contamination; in the event of such an occurrence, the package containing the appropriate spill control assembly can be more easily and specifically identified by matching the label and display colors.

2. Description of the Prior Art

Spill control and containment products have long been a tool used in compliance with EPA spill prevention, control, and countermeasure (SPCC) regulations. One such product comprises an appropriately combined assortment of materials which are vacuum packaged in foil wrappers or enclosures. In the event of a spill, the nature of the released contaminating material is identified and the corresponding assortment of materials is removed from its packaging and applied to the spill. Spill control products of this type are illustrated in U.S. Pat. No. D326,222, incorporated by reference herein.

However, in actual practice, these types of spill control products have created problems, particularly with inexperienced and improperly trained personnel. Specifically, in the often disturbing and even chaotic conditions encountered during material spills, the wrong product not designed for the spill in question can be erroneously used. This not only fails to ameliorate the problem, but can even exacerbate the situation.

There is accordingly a need in the art for improved systems, methods, and products which overcome these difficulties and provide for ready and error-free use of spill remediation materials which are appropriate for different types of spills.

SUMMARY OF THE INVENTION

The present invention overcomes the problems outlined above and provides a material spill control system comprising a plurality of individual spill control packages, each package specially designed to counteract a particular, different type of material release, and including an assembly made up of appropriate spill control materials and optional protective gear within an openable casing. A respective color-coded display is carried by each of the individual packages, with each display having a primary color different than that of every other package. A color-coordinated label is also associated with each of the spill control packages and is operable to be displayed at a source location where the particular type of material may be commonly stored, contained, or processed in the event that said material may be spilled or leaked. Each label has a surface bearing the same primary color as the respective display of the associated spill control package, so that the correct spill control package for a particular material spill release may be readily identified by matching the color of the label surface and the color of the associated package display.

In actual practice, individually packaged spill control assemblies are provided for battery acid, oil and oil-based materials, chemical/hazardous materials, and non-aggressive spills. Preferably, the display and label for the battery acid spill control package have a predominantly red color, the display and label for the oil and oil-based materials spill control package have a predominantly blue color, the display and label for the chemical/hazardous materials spill control package have a predominantly yellow color, and the display and label for the non-aggressive spill control package have a predominantly orange color. Of course, other coordinated color schemes may be used to equal effect.

In use, locations are identified within a plant or area to be protected which are deemed to be where particular, different types of materials are stored, contained, or processed. These locations or sources are then pre-labeled using the detachable package labels, and the associated spill control packages may be placed in a central location or adjacent the corresponding locations. In the event of a spill, the color-coordinated label can be used to rapidly and correctly identify the type of spill control package to be opened and used, allowing quick deployment and consequent spill containment and remediation.

DETAILED DESCRIPTION OF THE PREFERRED EMBODIMENT

Figure 1:
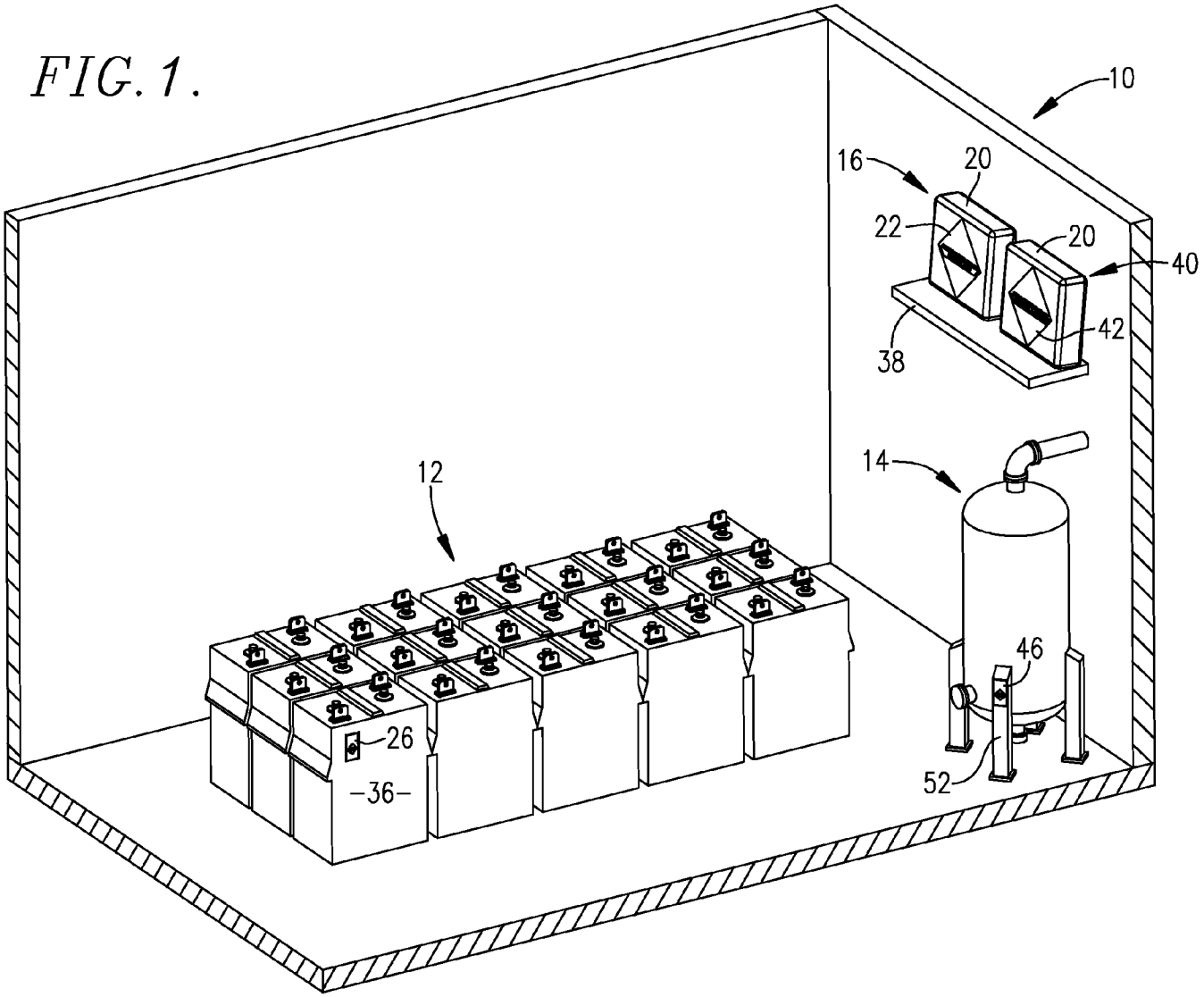
FIG. 1 is a perspective view of an area subject to hazardous material spills and depicting the use of the spill control system of the invention.

Turning now to the drawings, FIG. 1 illustrates a plant area 10 having two different locations where hazardous materials spills may occur, namely a bank of batteries 12 and a chemical processing tank 14. As such, spills of battery acid can occur adjacent the battery bank 12, whereas a chemical spill may happen at the area of the tank 14 and its piping.

Figure 2:
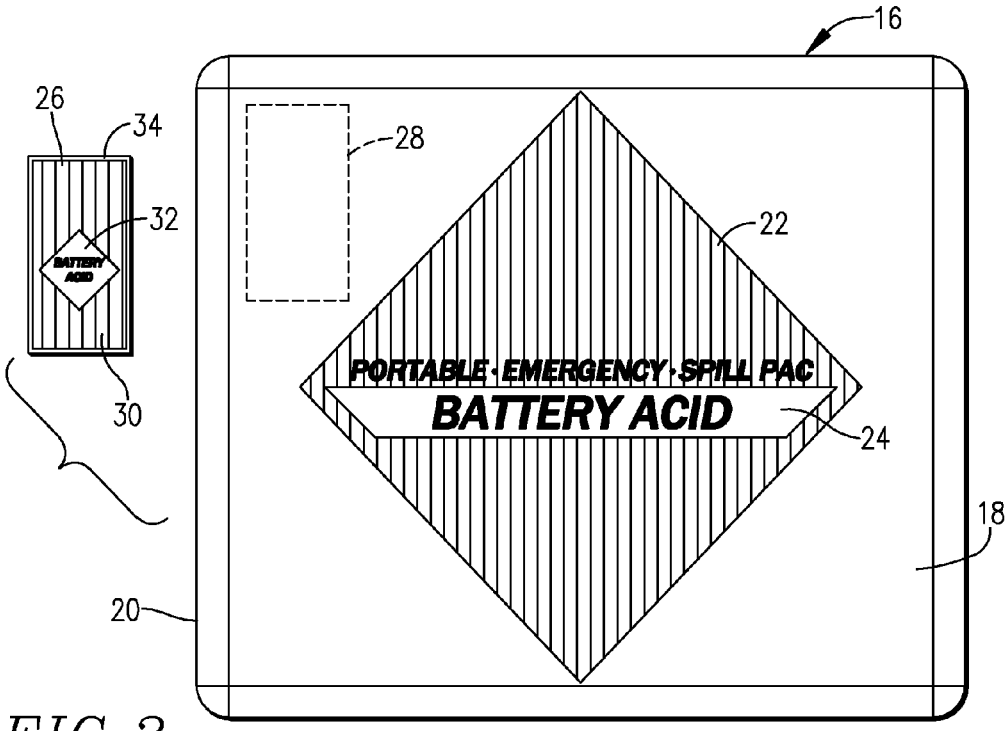
FIG. 2 is an exploded elevational view of one type of spill control package designed to counteract a battery acid spill and illustrating the package with a red display and with a detachable red spill location label.

FIG. 2 illustrates a hazardous material spill package 16 designed to be used to counteract a battery acid spill. The package 16 includes an assembly of materials 18 which are specifically produced for absorbing 47% sulfuric acid used with industrial batteries, as well as protective gear to be worn by an individual using the assembly 18. The assembly 18 is encased within a vacuumized metallic foil casing 20 having sealed edges, an integrated carry handle, optional wall mounting grommets, and a tear notch (not shown) allowing the casing to be quickly opened. The package 16 also has a display 22 mounted on one face thereof which is predominantly red in color with text 24 indicating the battery acid use.

In addition, a removable label 26 is secured to the casing 20 at location 28, typically by adhesive tape or other means. The label 26 has an outer, imprinted surface 30 which is likewise predominantly red in color to match the display 22, and also has battery acid usage text 32 thereon. The opposite face of label 26 has adhesive on it and is normally covered by a strippable backing sheet 34. The entire package 16 with casing 20, display 22, and label 26 is preferably within a clear synthetic resin overwrap (not shown) which is removed prior to use of the package 16.

In the use of package 16, the location of a potential battery acid spill is identified, namely the region at or around the bank of batteries 12. The label 26 is then detached from casing 20 and the backing 34 is removed. The label 26 is next adhesively secured to an appropriate, highly visible surface 36 at or near the batteries 12, as illustrated in FIG. 1. The package 16, minus the associated label 26, can then be stored on a shelf 38 or at some other centrally located or easily accessible location. In the event of a battery acid spill, attending personnel would note the colored label 26 and immediately associate it with the package 16 bearing the similarly colored display 22. The casing 20 would then be opened, the enclosed protective gear donned, and the spill control assembly therein would be used to contain and absorb the battery acid spill.

Figure 3:
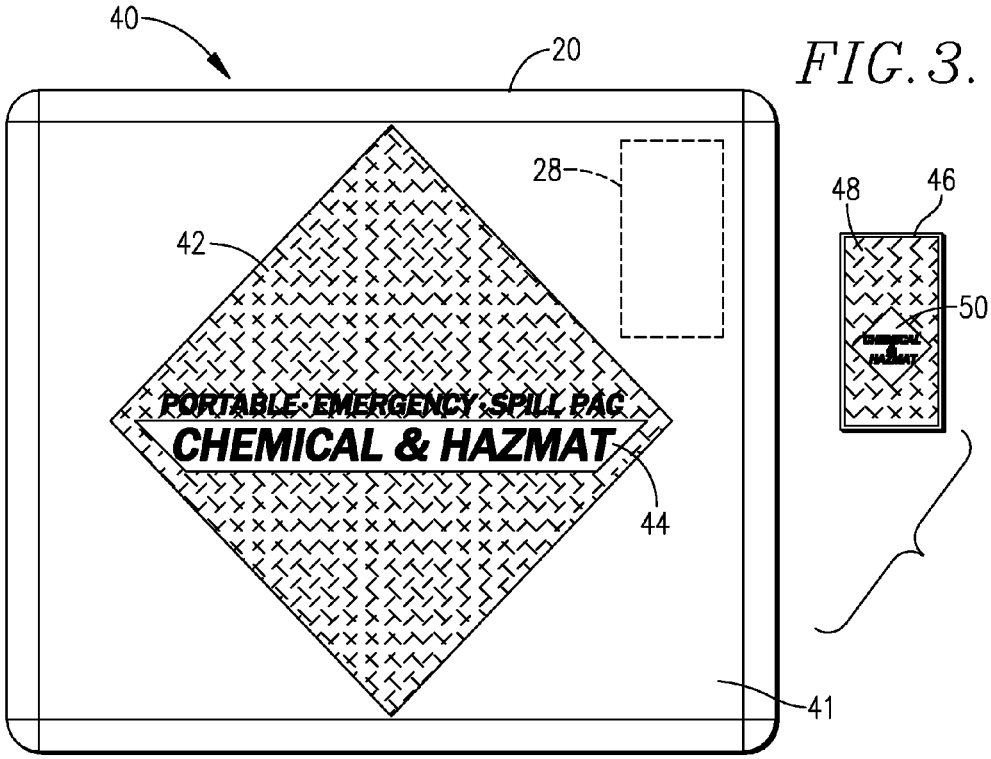
FIG. 3 is an exploded elevational view of another type of spill control package designed to counteract chemical/hazardous materials spills and illustrating the package with a yellow display and with a detachable yellow spill location label.

FIG. 3 illustrates another type of spill control package 40 for use in remediation of chemical/hazardous materials spills. The package 40 has a properly pre-treated chemical/hazardous material spill control materials 41 and protective gear. The appearance of package 40 is similar to that of package 16, except that the display 42 thereof is predominantly yellow in color and bears chemical/hazmat text 44. Further, the label 46 associated with the package 40 has its outer face 48 colored in the same yellow as that of display 42, and it also has appropriate use text 50 thereon. Just as in the case of package 16, the use of package 40 involves preliminary placement of the label 46 at an appropriate place 52 at or near the tank 14 prior to the occurrence of any spill. Also, the package 40 minus label 46 is placed on shelf 38 or at a central storage location.

It will be appreciated that the color coordination between the display 22 and label 26, and the different color coordination between the display 42 and label 46, virtually assures that the proper spill control package will be used. Only minimal employee training is required to achieve this result. It has been found that the pre-labeling of potential spill locations with the appropriately colored labels allows very quick and error-free response to different spills as they may occur. The use of vacuum-packed spill control assemblies, which protect against pilferage, inadvertent damage, and environmental degradation, together with the color-coordinated displays and labels, provides a complete system solution to the spill remediation issues faced in today's industrial environments.

I claim:

1. A material spill control system, comprising:

a plurality of individual spill control packages, each package containing a spill control assembly, each assembly designed to counteract a particular, different type of hazardous or non-hazardous material release;

a respective color-coded display on each of said individual packages, each display having a color different than that of every other package; and a color-coordinated label associated with each of said spill control packages and operable to be displayed at a location where the particular type of hazardous or non-hazardous material may be released or spilled, each label having a surface bearing the same color as the respective display of the associated spill control package.

2. The spill control system of claim 1, each of said spill control assemblies comprising a combined assortment of materials designed for the containment and absorption of a specific material release, with each combined assortment of materials within an individual package.

3. The spill control system of claim 1, each label being releasably secured to the associated spill control package.

4. The spill control system of claim 3, each label having adhesive on the face thereof remote from the color-bearing surface.

5. The spill control system of claim 1, there being a spill control package for battery acid, oil and oil-based materials, chemical/hazardous materials, and non-aggressive spills.

6. The spill control system of claim 5, the display and label for said battery acid spill control assembly having a predominantly red color, the display and label for said oil and oil-based materials spill control assembly having a predominantly blue color, the display and label for said chemical/hazardous materials spill control assembly having a predominantly yellow color, and the display and label for said non-aggressive spill control assembly having a predominantly orange color.

7. A hazardous or non-hazardous material spill package, comprising:

a casing;

a spill control assembly within said casing and designed to counteract a particular type of material, said spill control assembly being accessible by a user by opening of the casing; and a display carried by said package and having a distinctive color; and a color-coordinated label releasably secured to said package and having the same color as said display, said label being detachable from the package and attachable to a location subject to a spill of said particular type of hazardous or non-hazardous material.

8. The assembly of claim 7, said casing being evacuated.

9. The assembly of claim 7, said spill control assembly including protective gear to be worn by said user.

10. The assembly of claim 7, said spill control assembly designed to counteract a spill selected from the group consisting of battery acid, oil and oil-based materials, chemical/hazardous materials, and non-aggressive spills.

11. The assembly of claim 10, the display and label for said battery acid spill control assembly having a predominantly red color, the display and label for said oil and oil-based materials spill control assembly having a predominantly blue color, the display and label for said chemical/hazardous materials spill control assembly having a predominantly yellow color, and the display and label for said non-aggressive spill control assembly having a predominantly orange color.

* * * * *